US010873810B2

(12) United States Patent
Kawai et al.

(10) Patent No.: US 10,873,810 B2
(45) Date of Patent: Dec. 22, 2020

(54) SOUND PICKUP DEVICE AND SOUND PICKUP METHOD

(71) Applicant: YAMAHA CORPORATION, Hamamatsu (JP)

(72) Inventors: Tetsuto Kawai, Hamamatsu (JP); Mikio Muramatsu, Fukuroi (JP); Takayuki Inoue, Hamamatsu (JP); Satoshi Ukai, Waltham, MA (US)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/572,825

(22) Filed: Sep. 17, 2019

(65) Prior Publication Data

US 2020/0015010 A1 Jan. 9, 2020

Related U.S. Application Data

(63) Continuation of application No. PCT/JP2018/011318, filed on Mar. 22, 2018.

(30) Foreign Application Priority Data

Mar. 24, 2017 (JP) ..... 2017-059020

(51) Int. Cl.
*H04R 3/04* (2006.01)
*H04R 1/08* (2006.01)
(Continued)

(52) U.S. Cl.
CPC ..... *H04R 3/04* (2013.01); *G10L 21/0208* (2013.01); *G10L 21/0264* (2013.01); *H04R 1/08* (2013.01);
(Continued)

(58) Field of Classification Search
CPC . H04R 3/04; H04R 1/08; H04R 1/406; H04R 3/005; H04R 29/004; H04R 2201/40; G10L 21/0208; G10L 21/0264
See application file for complete search history.

(56) References Cited

U.S. PATENT DOCUMENTS 7,171,008 B2 1/2007 Elko
7,174,022 B1 2/2007 Zhang
(Continued)

FOREIGN PATENT DOCUMENTS

JP S627298 A 1/1987
JP H0667691 A 3/1994
(Continued)

OTHER PUBLICATIONS

International Search Report issued in Intl. Appln. No. PCT/JP2018/011318 dated May 15, 2018. English translation provided.
(Continued)

*Primary Examiner* — Andrew L Sniezek
(74) *Attorney, Agent, or Firm* — Rossi, Kimms & McDowell LLP

(57) ABSTRACT

A sound pickup method obtains a correlation between a first sound pickup signal to be generated from a first microphone and a second sound pickup signal to be generated from a second microphone, and performs level control of the first sound pickup signal or the second sound pickup signal, according to a ratio of a frequency component of which the correlation exceeds a threshold value.

19 Claims, 17 Drawing Sheets

(51) Int. Cl.

| | |
|---|---|
| ***H04R 3/00*** | (2006.01) |
| ***G10L 21/0208*** | (2013.01) |
| ***G10L 21/0264*** | (2013.01) |
| ***H04R 29/00*** | (2006.01) |
| ***H04R 1/40*** | (2006.01) |

(52) U.S. Cl.
CPC ..... *H04R 1/406* (2013.01); *H04R 3/005* (2013.01); *H04R 29/004* (2013.01); *H04R 2201/40* (2013.01)

(56) References Cited

U.S. PATENT DOCUMENTS

| | | | | |
|---|---|---|---|---|
| 7,561,700 | B1 * | 7/2009 | Bernardi | H04R 3/005 381/313 |
| 2005/0074129 | A1 | 4/2005 | Fan | |
| 2008/0226098 | A1 | 9/2008 | Haulick | |
| 2008/0317261 | A1 | 12/2008 | Yoshida | |
| 2011/0313763 | A1 | 12/2011 | Amada | |
| 2013/0066628 | A1 | 3/2013 | Takahashi | |
| 2014/0376744 | A1 | 12/2014 | Hetherington | |
| 2015/0281834 | A1 | 10/2015 | Takano | |
| 2015/0294674 | A1 | 10/2015 | Takahashi | |
| 2016/0073203 | A1 | 3/2016 | Kuriger | |
| 2019/0116422 | A1 | 4/2019 | Song | |
| 2020/0021932 | A1 * | 1/2020 | Ukai | H04R 1/406 |

FOREIGN PATENT DOCUMENTS

| | | | |
|---|---|---|---|
| JP | H1118193 | A | 1/1999 |
| JP | 2004289762 | A | 10/2004 |
| JP | 2006129434 | A | 5/2006 |
| JP | 2009005133 | A | 1/2009 |
| JP | 2013061421 | A | 4/2013 |
| JP | 2015194753 | A | 11/2015 |
| JP | 2016042613 | A | 3/2016 |

OTHER PUBLICATIONS

Written Opinion issued in Intl. Appln. No. PCT/JP2018/011318 dated May 15, 2018.
Partial Supplementary European Search Report issued in European Appln. No. 18772153.5 dated Aug. 21, 2020.
Office Action issued in U.S. Appl. No. 16/578,493 dated Apr. 27, 2020.
Office Action issued in U.S. Appl. No. 16/578,493 dated Jul. 27, 2020.
International Search Report issued in Intl. Appln. No. PCT/JP2017/012071 dated May 23, 2017. English translation provided. Cited in Copending US Pub. 20200021932, which was previously cited.
Written Opinion issued in Intl. Appln. No. PCT/JP2017/012071 dated May 23, 2017. English translation provided. Cited in Copending US Pub. 20200021932, which was previously cited.
Office Action issued in Japanese Appln. No. 2019-506898 dated Jun. 23, 2020. English machine translation provided. Cited in Copending US Pub. 20200021932, which was previously cited.
Partial Supplementary European Search Report issued in European Appln. No. 17901438.6 dated Aug. 31, 2020.
Office Action issued in Japanese Appln. No. 2019-506958 dated Nov. 10, 2020. English machine translation provided.

* cited by examiner

SOUND PICKUP DEVICE AND SOUND PICKUP METHOD

CROSS REFERENCE TO RELATED APPLICATIONS

The present application is a continuation application of International Patent Application No. PCT/JP2018/011318, filed on Mar. 22, 2018, which claims priority to Japanese Patent Application No. 2017-059020, filed on Mar. 24, 2017. The contents of these applications are incorporated herein by reference in their entirety.

BACKGROUND OF THE INVENTION

1. Field of the Invention

A preferred embodiment of the present invention relates to a sound pickup device and a sound pickup method that obtain sound from a sound source by using a microphone.

2. Description of the Related Art

Japanese Unexamined Patent Application Publication No. 2016-042613, Japanese Unexamined Patent Application Publication No. 2013-061421, and Japanese Unexamined Patent Application Publication No. 2006-129434 disclose a technique to obtain coherence of two microphones, and emphasize a target sound such as voice of a speaker.

For example, the technique of Japanese Unexamined Patent Application Publication No. 2016-042613 obtains an average coherence of two signals by using two non-directional microphones and determines whether or not the sound is a target sound based on an obtained average coherence value.

The conventional technique does not disclose that distant noise is reduced.

SUMMARY OF THE INVENTION

In view of the foregoing, an object of a preferred embodiment of the present invention is to provide a sound pickup device and a sound pickup method that are able to reduce distant noise with higher accuracy than conventionally.

A sound pickup device according to a preferred embodiment of the present invention includes a correlation calculator and a level controller. The correlation calculator obtains a correlation between a first sound pickup signal to be generated from a first microphone and a second sound pickup signal to be generated from a second microphone. The level controller performs level control of the first sound pickup signal or the second sound pickup signal, according to a ratio of a frequency component of which the correlation exceeds a threshold value.

According to a preferred embodiment of the present invention, distant noise is able to be reduced with higher accuracy than conventionally.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A sound pickup device of the present preferred embodiment includes a first microphone, a second microphone, and a level controller. The level controller obtains a correlation between a first sound pickup signal to be generated from the first microphone and a second sound pickup signal to be generated from the second microphone, and performs level control of the first sound pickup signal or the second sound pickup signal, according to a ratio of a frequency component of which the correlation exceeds a threshold value.

Since nearby sound and distant sound include at least a reflected sound, coherence of a frequency may be extremely reduced. When a calculated value includes such an extremely low value of coherence, the average may be reduced. However, the ratio only affects how many frequency components that are equal to or greater than a threshold value are present, and whether the value itself of the coherence in a frequency that is less than a threshold value is a low value or a high value does not affect the level control at all. Accordingly, the sound pickup device, by performing the level control according to the ratio, a target sound is able to be emphasized with high accuracy and distant noise is able to be reduced.

Figure 1:
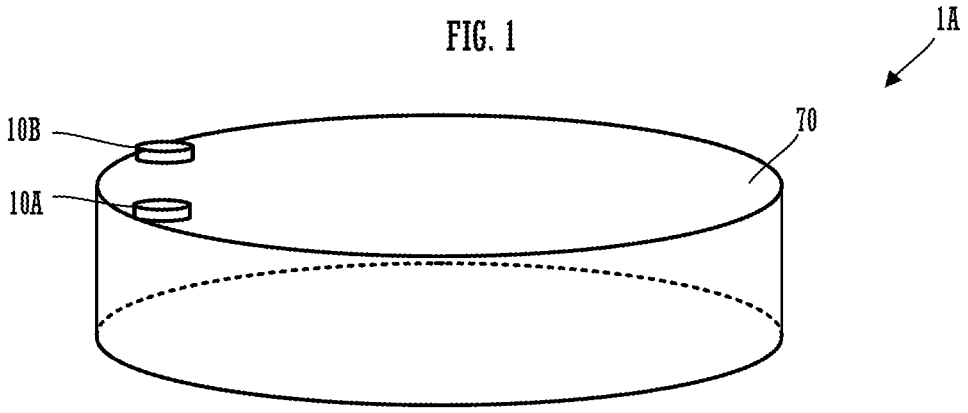
FIG. 1 is a schematic view showing a configuration of a sound pickup device 1A.

FIG. 1 is an external schematic view showing a configuration of a sound pickup device 1A. In FIG. 1, the main configuration according to sound pickup is described and other configurations are not described. The sound pickup device 1A includes a cylindrical housing 70, a microphone 10A, and a microphone 10B.

The microphone 10A and the microphone 10B are disposed on an upper surface of the housing 70. However, the shape of the housing 70 and the placement aspect of the microphones are merely examples and are not limited to these examples.

Figure 2:
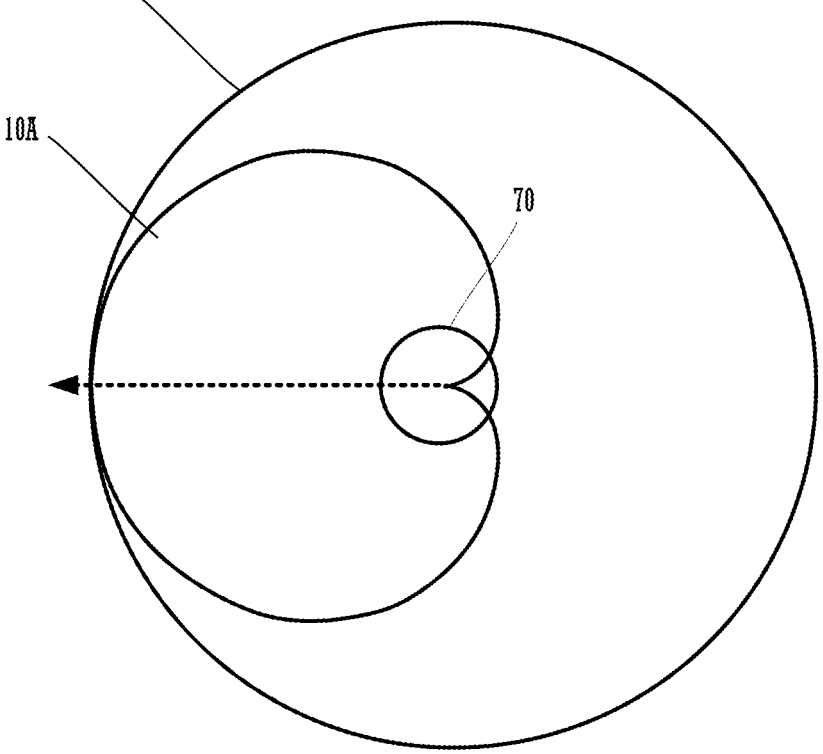
FIG. 2 is a plan view showing directivity of a microphone 10A and a microphone 10B.

FIG. 2 is a plan view showing directivity of the microphone 10A and the microphone 10B. As an example, the microphone 10A is a directional microphone having the highest sensitivity in front (the left direction in the figure) of the device and having no sensitivity in back (the right direction in the figure) of the device. The microphone 10B is a non-directional microphone having uniform sensitivity in all directions. However, the directional aspect of the microphone 10A and the microphone 10B is not limited to this example. For example, both the microphone 10A and the microphone 10B may be non-directional microphones or may be both directional microphones. In addition, the number of microphones may not be limited to two, and, for example, three or more microphones may be provided.

Figure 3:
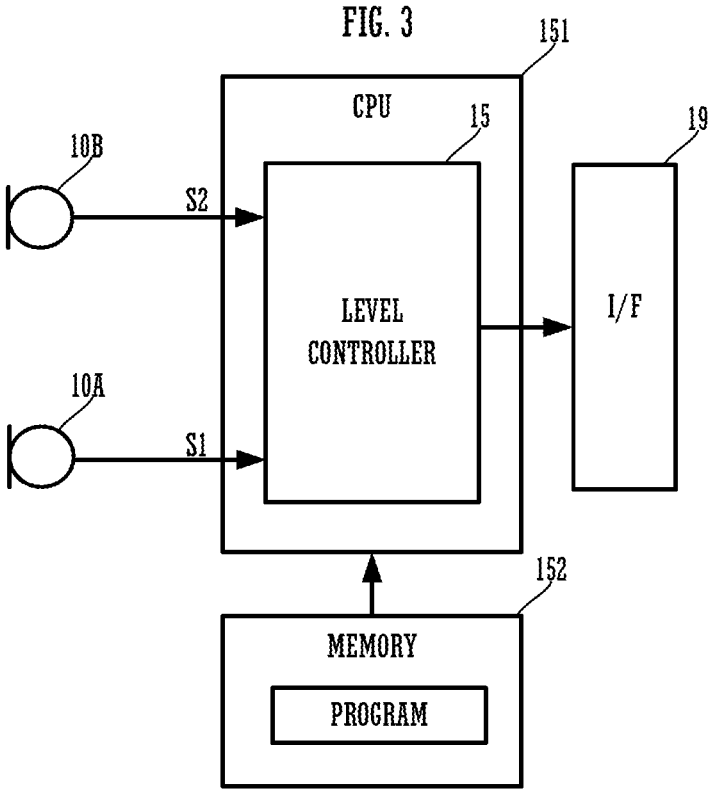
FIG. 3 is a block diagram showing a configuration of the sound pickup device 1A.

FIG. 3 is a block diagram showing a configuration of the sound pickup device 1A. The sound pickup device 1A includes the microphone 10A, the microphone 10B, a level controller 15, and an interface (I/F) 19. The level controller 15 is achieved as a function of software when a CPU (Central Processing Unit) 151 reads out a program stored in a memory 152 being a storage medium. However, the level controller 15 may be achieved by dedicated hardware such as an FPGA (Field-Programmable Gate Array). In addition, the level controller 15 may be achieved by a DSP (Digital Signal Processor).

The level controller 15 receives an input of a sound pickup signal S1 of the microphone 10A and a sound pickup signal S2 of the microphone 10B. The level controller 15 performs level control of the sound pickup signal S1 of the microphone 10A or the sound pickup signal S2 of the microphone 10B, and outputs the signal to the I/F 19. The I/F 19 is a communication interface such as a USB or a LAN. The sound pickup device 1A outputs a pickup signal to other devices through the I/F 19.

Figure 4:
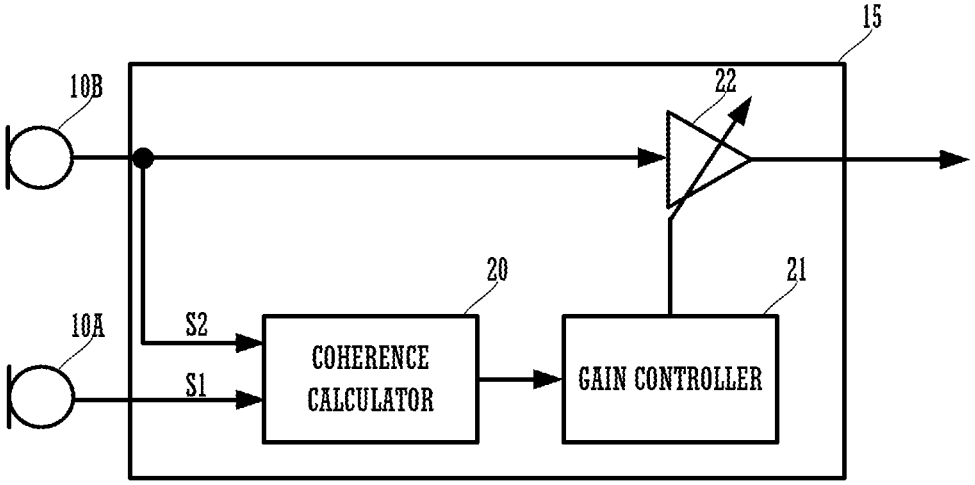
FIG. 4 is a view showing an example of a configuration of a level controller 15.

FIG. 4 is a view showing an example of a functional configuration of the level controller 15. The level controller 15 includes a coherence calculator 20, a gain controller 21, and a gain adjuster 22.

The coherence calculator 20 receives an input of the sound pickup signal S1 of the microphone 10A and the sound pickup signal S2 of the microphone 10B. The coherence calculator 20 calculates coherence of the sound pickup signal S1 and the sound pickup signal S2 as an example of the correlation.

The gain controller 21 determines a gain of the gain adjuster 22, based on a calculation result of the coherence calculator 20. The gain adjuster 22 receives an input of the sound pickup signal S2. The gain adjuster 22 adjusts a gain of the sound pickup signal S2, and outputs the adjusted signal to the I/F 19.

It is to be noted that, while this example shows an aspect in which the gain of the sound pickup signal S2 of the microphone 10B is adjusted and the signal is outputted to the I/F 19, an aspect in which a gain of the sound pickup signal S1 of the microphone 10A is adjusted and the adjusted signal is outputted to the I/F 19 may be employed. However, the microphone 10B as a non-directional microphone is able to pick up sound of the whole surroundings. Therefore, it is preferable to adjust the gain of the sound pickup signal S2 of the microphone 10B, and to output the adjusted signal to the I/F 19.

The coherence calculator 20 converts the signals into a signal X(f, k) and a signal Y(f, k) of a frequency axis (S11) by applying the Fourier transform to each of the sound pickup signal S1 and the sound pickup signal S2. The "f" represents a frequency and the "k" represents a frame number. The coherence calculator 20 calculates coherence (a time average value of the complex cross spectrum) according to the following Expression 1 (S12).

$$\gamma^2(f,k) = \frac{|C_{xy}(f,k)|^2}{P_x(f,k)P_y(f,k)} \qquad \text{Expression 1}$$

$$C_{xy}(f,k) = (1-\alpha)C_{xy}(f,k-1) + \alpha X(f,k)Y(f,k)^*$$

$$P_x(f,k) = (1-\alpha)P_x(f,k-1) + \alpha|X(f,k)|^2$$

$$P_y(f,k) = (1-\alpha)P_y(f,k-1) + \alpha|Y(f,k)|^2$$

However, the Expression 1 is an example. For example, the coherence calculator 20 may calculate the coherence according to the following Expression 2 or Expression 3.

$$\gamma^2(f, mT+k) = \qquad \text{Expression 2}$$

$$\frac{\left|\frac{1}{T}\sum_{0\le l<T} X(f,(m-1)T+l)Y(f,(m-1)T+l)^*\right|^2}{\left(\frac{1}{T}\sum_{0\le l<T}|X(f,(m-1)T+l)|^2\right)\left(\frac{1}{T}\sum_{0\le l<T}|Y(f,(m-1)T+l)|^2\right)}$$

$$\gamma^2(f,k) = \frac{\left|\frac{1}{T}\sum_{0\le l<T} X(f,k-l)Y(f,k-l)^*\right|^2}{\left(\frac{1}{k}\sum_{0\le l<T}|X(f,k-l)|^2\right)\left(\frac{1}{k}\sum_{0\le l<T}|Y(f,k-l)|^2\right)} \qquad \text{Expression 3}$$

It is to be noted that the "m" represents a cycle number (an identification number that represents a group of signals including a predetermined number of frames) and the "T" represents the number of frames of 1 cycle.

The gain controller 21 determines the gain of the gain adjuster 22, based on the coherence. For example, the gain controller 21 obtains a ratio R(k) of a frequency bin of which the amplitude of the coherence exceeds a predetermined threshold value γth, with respect to all frequencies (the number of frequency bins) (S13).

$$R(k) = \frac{Count_{f_0\le f\le f_1}\{\gamma^2(f,k) > \gamma_{th}^2\}}{f_1 - f_0} : MSC\ \text{Rate} \qquad \text{Expression 4}$$

The threshold value γth is set to γth=0.6, for example. It is to be noted that f0 in the Expression 4 is a lower limit frequency bin, and f1 is an upper limit frequency bin.

Figure 5A:
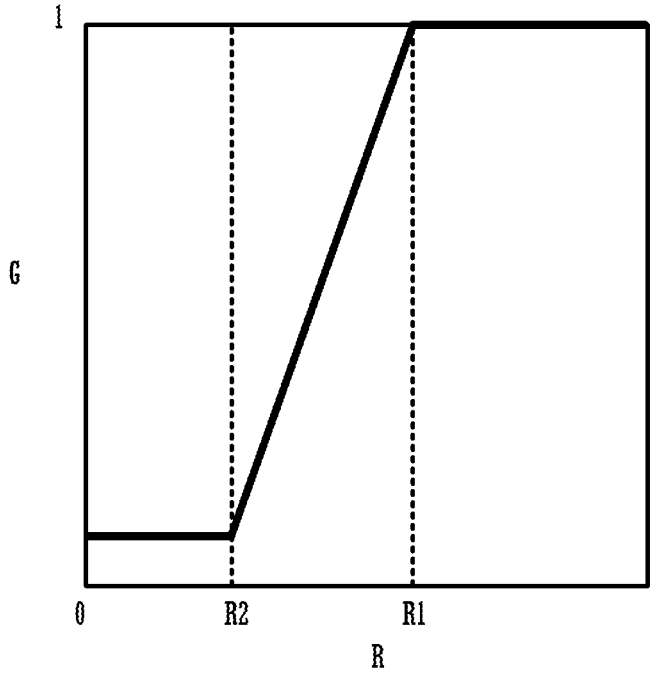
FIG. 5A is a view showing an example of a gain table.

The gain controller 21 determines the gain of the gain adjuster 22 according to this ratio R(k) (S14). More specifically, the gain controller 21 determines whether or not coherence exceeds a threshold value γth for each frequency bin, totals the number of frequency bins that exceed the threshold value, and determines a gain according to a total result. FIG. 5(A) is a view showing an example of a gain table. According to the gain table in the example shown in FIG. 5(A), the gain controller 21 does not attenuate the gain when the ratio R is equal to or greater than a predetermined value R1 (gain=1). The gain controller 21 sets the gain to be attenuated as the ratio R is reduced when the ratio R is from the predetermined value R1 to a predetermined value R2. The gain controller 21 maintains the minimum gain value when the ratio R is less than R2. The minimum gain value may be 0 or may be a value that is slightly greater than 0, that is, a state in which sound is able to be heard very slightly. Accordingly, a user does not misunderstand that sound has been interrupted due to a failure or the like.

Coherence shows a high value when the correlation between two signals is high. Distant sound has a large number of reverberant sound components, and is a sound of which an arrival direction is not fixed. For example, in a case in which the microphone 10A has directivity and the microphone 10B is non-directivity, sound pickup capability to distant sound is greatly different. Therefore, coherence is reduced in a case in which sound from a distant sound source is inputted, and is increased in a case in which sound from a sound source near the device is inputted.

Therefore, the sound pickup device 1A does not pick up sound from a sound source far from the device, and is able to emphasize sound from a sound source near the device as a target sound.

The sound pickup device 1A of the present preferred embodiment has shown an example in which the gain controller 21 obtains the ratio R(k) of a frequency of which the coherence exceeds a predetermined threshold value γth, with respect to all frequencies, and performs gain control according to the ratio. Since nearby sound and distant sound include a reflected sound, the coherence of a frequency may be extremely reduced. When such an extremely low value is included, the average may be reduced. However, the ratio R(k) only affects how many frequency components that are equal to or greater than a threshold value are present, and whether the value itself of the coherence that is less than a threshold value is a low value or a high value does not affect gain control at all, so that, by performing the gain control according to the ratio R(k), distant noise is able to be reduced and a target sound is able to be emphasized with high accuracy.

It is to be noted that, although the predetermined value R1 and the predetermined value R2 may be set to any value, the predetermined value R1 is preferably set according to the maximum range in which sound is desired to be picked up without being attenuated. For example, in a case in which the position of a sound source is farther than about 30 cm in radius and in a case in which a value of the ratio R of coherence is reduced, a value of the ratio R of coherence when a distance is about 40 cm is set to the predetermined value R1, so that sound is able to be picked up without being attenuated up to a distance of about 40 cm in radius. In addition, the predetermined value R2 is set according to the minimum range in which sound is desired to be attenuated. For example, a value of the ratio R when a distance is 100 cm is set to the predetermined value R2, so that sound is hardly picked up when a distance is 100 cm or more while sound is picked up as the gain is gradually increased when a distance is closer to 100 cm.

In addition, the predetermined value R1 and the predetermined value R2 may not be fixed values, and may dynamically be changed. For example, the level controller 15 obtains an average value R0 (or the greatest value) of the ratio R obtained in the past within a predetermined time, and sets the predetermined value R1=R0+0.1 and the predetermined value R2=R0-0.1. As a result, with reference to a position of the current sound source, sound in a range closer to the position of the sound source is picked up and sound in a range farther than the position of the sound source is not picked up.

Figure 5B:
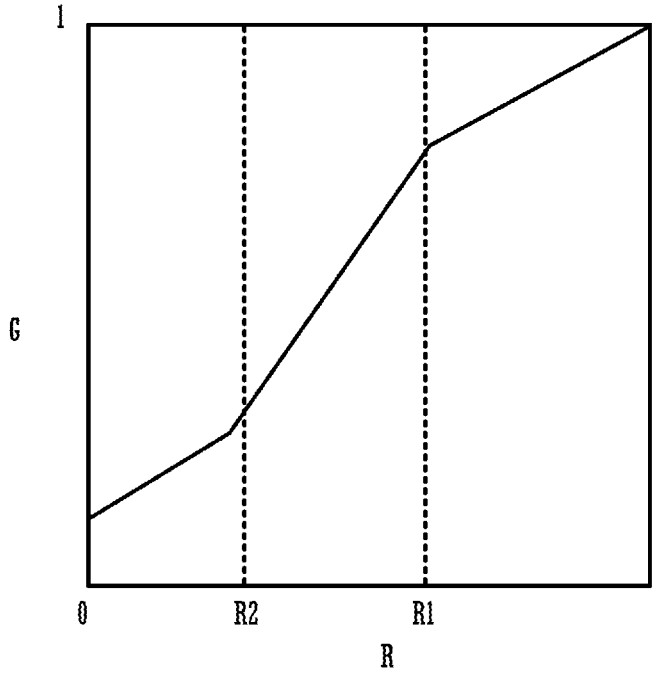
FIG. 5B is a view showing an example of a gain table different from FIG. 5A.

It is to be noted that the example of FIG. 5A shows an aspect in which the gain is drastically reduced from a predetermined distance (30 cm, for example) and sound from a sound source beyond a predetermined distance (100 cm, for example) is hardly picked up, which is similar to the function of a limiter. However, the gain table, as shown in FIG. 5B, also shows various aspects. In the example of FIG. 5B, it is an aspect in which the gain is gradually reduced according to the ratio R, the reduction degree of the gain is increased from the predetermined value R1, and the gain is again gradually reduced at the predetermined value R2 or less, which is similar to the function of a compressor.

Figure 6:
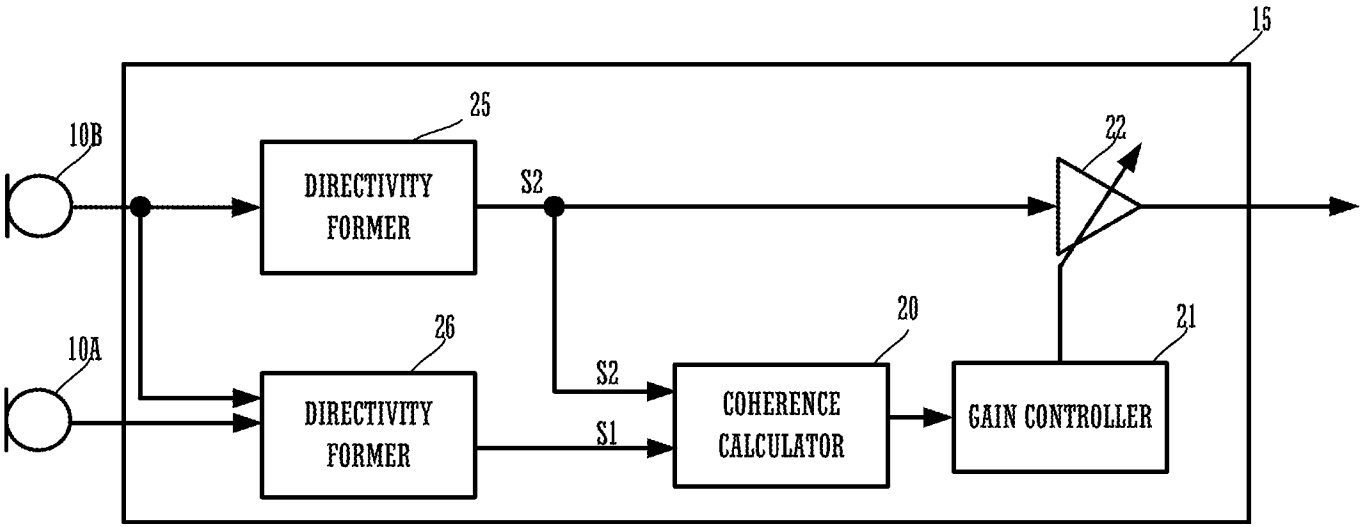
FIG. 6 is a view showing a configuration of a level controller 15 according to Modification 1.
Figure 7A:
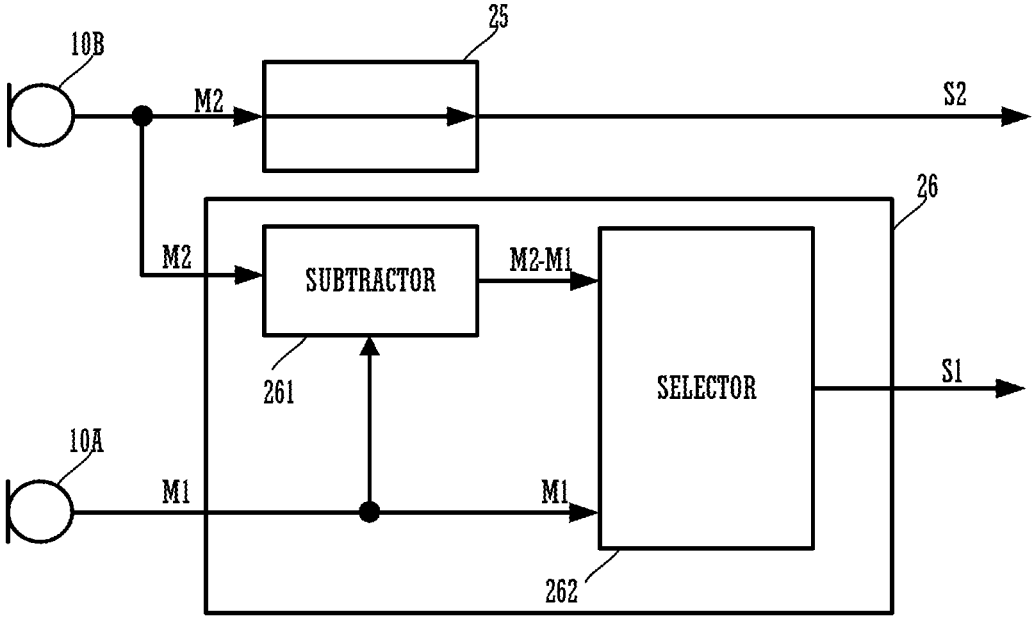
FIG. 7A is a block diagram showing a functional configuration of a directivity former 25 and a directivity former 26.
Figure 13:
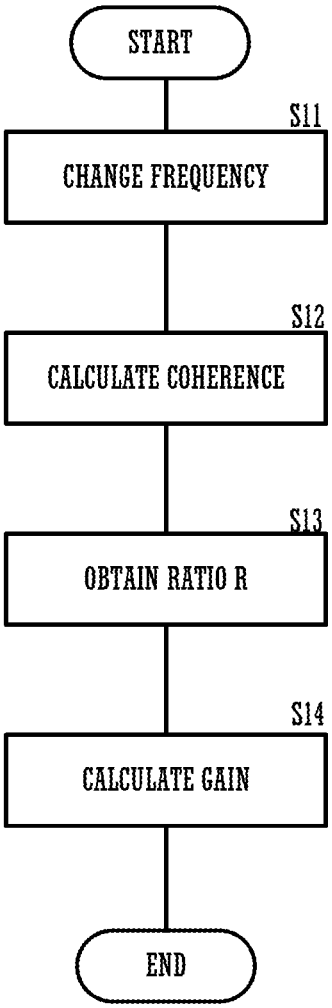
FIG. 13 is a flow chart showing an operation of the level controller 15.

Subsequently, FIG. 6 is a view showing a configuration of a level controller 15 according to Modification 1. The level controller 15 includes a directivity former 25 and a directivity former 26. FIG. 13 is a flow chart showing an operation of the level controller 15 according to Modification 1. FIG. 7A is a block diagram showing a functional configuration of the directivity former 25 and the directivity former 26.

The directivity former 25 outputs an output signal M2 of the microphone 10B as the sound pickup signal S2 as it is. The directivity former 26, as shown in FIG. 7A, includes a subtractor 261 and a selector 262.

The subtractor 261 obtains a difference between an output signal M1 of the microphone 10A and the output signal M2 of the microphone 10B, and inputs the difference into the selector 262.

Figure 7B:
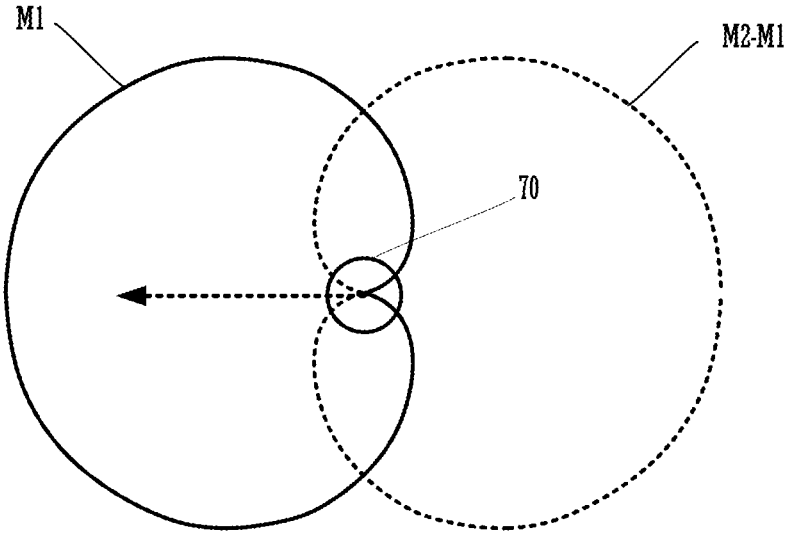
FIG. 7B is a plan view showing directivity.
Figure 14:
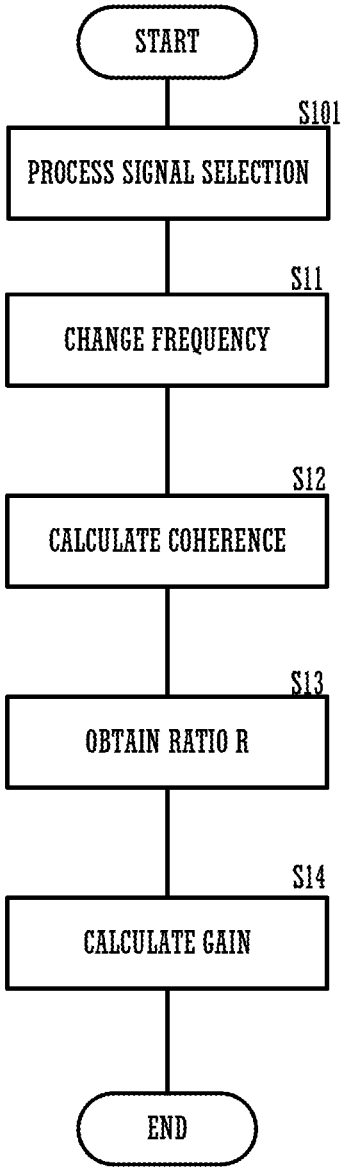
FIG. 14 is a flow chart showing an operation of the level controller 15 according to Modification.

The selector 262 compares a level of the output signal M1 of the microphone 10A and a level of a difference signal obtained from the difference between the output signal M1 of the microphone 10A and the output signal M2 of the microphone 10B, and outputs a signal at a high level as the sound pickup signal S1 (S101)(refer to FIG. 14). As shown in FIG. 7B, the difference signal obtained from the difference between the output signal M1 of the microphone 10A and the output signal M2 of the microphone 10B has the reverse directivity of the microphone 10B.

In this manner, the level controller 15 according to Modification 1, even when using a directional microphone (having no sensitivity to sound in a specific direction), is able to provide sensitivity to the whole surroundings of the device. Even in such a case, the sound pickup signal S1 has directivity, and the sound pickup signal S2 has non-directivity, which makes sound pickup capability to distant sound differ. Therefore, the level controller 15 according to Modification 1, while providing sensitivity to the whole surroundings of the device, does not pick up sound from a sound source far from the device, and is able to emphasize sound from a sound source near the device as a target sound.

The aspect of the directivity former 25 and the directivity former 26 is not limited to the example of FIG. 7A. In the pickup signal S1 and the pickup signal S2, in a case of an aspect in which the correlation with respect to a sound source near the housing 70 is high and the correlation with respect to a distant sound source is low, the configuration of the present preferred embodiment is able to be achieved.

Figure 10:
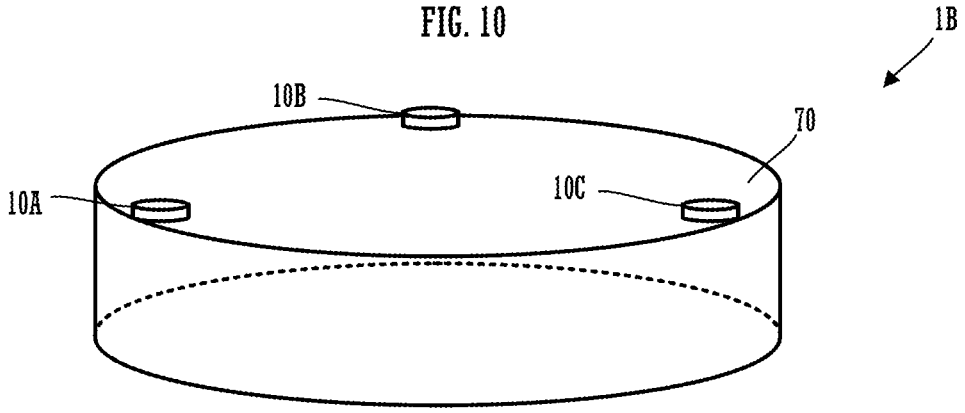
FIG. 10 is an external view of a sound pickup device 1B including three microphones (a microphone 10A, a microphone 10B, and a microphone 10C).

For example, FIG. 10 is an external view of a sound pickup device 1B including three microphones (a microphone 10A, a microphone 10B, and a microphone 10C).

Figure 11A:
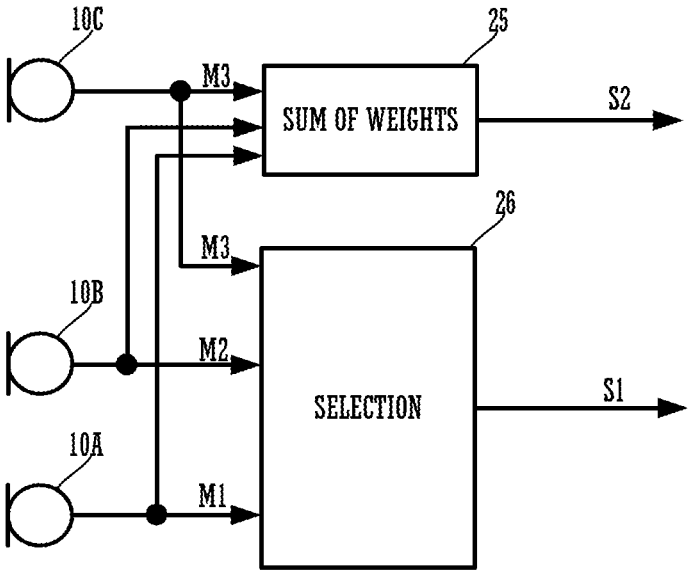
FIG. 11A is a view showing a functional configuration of a directivity former.
Figure 11B:
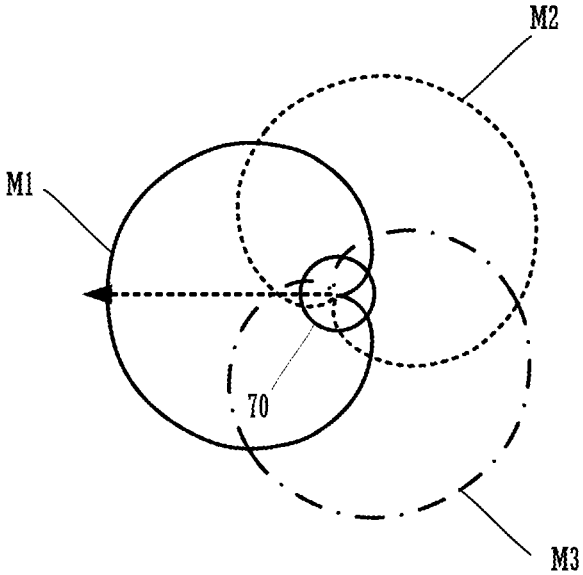
FIG. 11B is a view showing an example of directivity.

FIG. 11A is a view showing a functional configuration of a directivity former. FIG. 11B is a view showing an example of directivity.

As shown in FIG. 11B, in this example, all of the microphone 10A, the microphone 10B, and the microphone 10C are directional microphones. The microphone 10A, the microphone 10B, and the microphone 10C, in a plan view, have sensitivity in directions different from each other by 120 degrees.

The directivity former 26 in FIG. 11A selects any one of signals of the microphone 10A, the microphone 10B, and the microphone 10C, and forms a directional first sound pickup signal. For example, the directivity former 26 selects a signal at the highest level among the signals of the microphone 10A, the microphone 10B, and the microphone 10C.

The directivity former 25 in FIG. 11A calculates the sum of the weights of the signals of the microphone 10A, the microphone 10B, and the microphone 10C, and forms a non-directional second sound pickup signal.

As a result, the sound pickup device 1B, even when including all directional (having no sensitivity in a specific direction) microphones, is able to provide sensitivity to the whole surroundings of the device. Even in such a case, the sound pickup signal S1 has directivity, and the sound pickup signal S2 has non-directivity, which makes sound pickup capability to distant sound differ. Therefore, the sound pickup device 1B, while providing sensitivity to the whole surroundings of the device, does not pick up sound from a sound source far from the device, and is able to emphasize sound from a sound source near the device as a target sound.

Figure 12A:
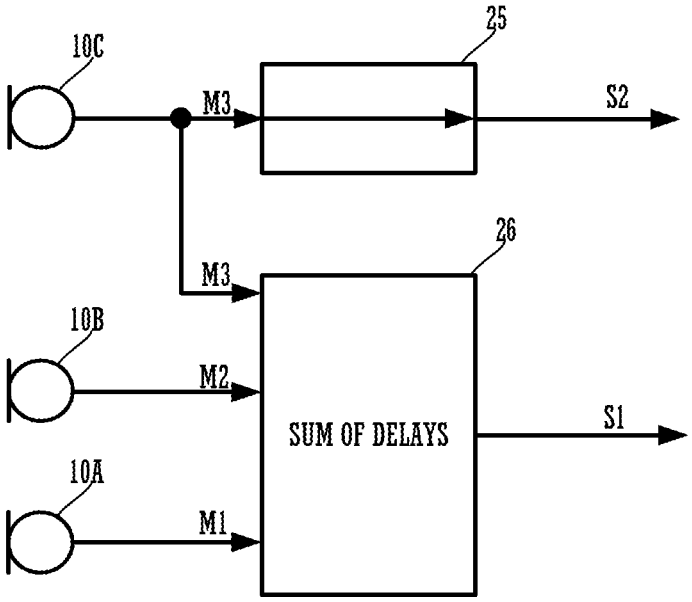
FIG. 12A is a view showing a functional configuration of a directivity former.
Figure 12B:
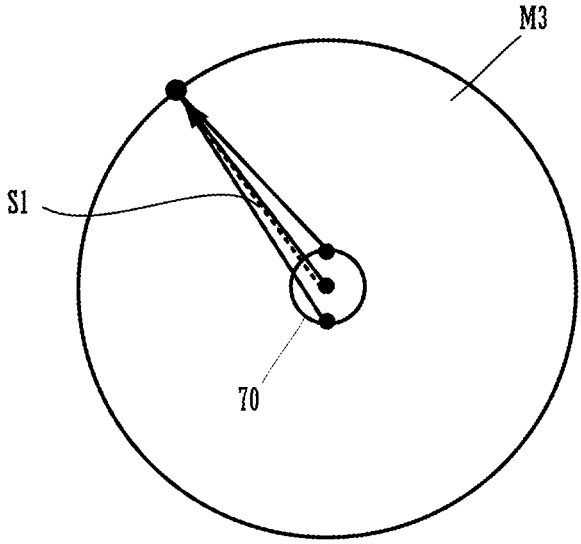
FIG. 12B is a view showing an example of directivity.

In addition, for example, even when all the microphones are non-directional microphones, for example, as shown in FIG. 12A, the directivity former 26 calculates the sum of delays, so that, as shown in FIG. 12B, a pickup signal S1 having a strong sensitivity in a specific direction is also able to be generated. In such a case, although the example shows that three non-directional microphones are used, a pickup signal S1 having a strong sensitivity in a specific direction is also able to be generated by using two or four or more non-directional microphones.

Figure 9:
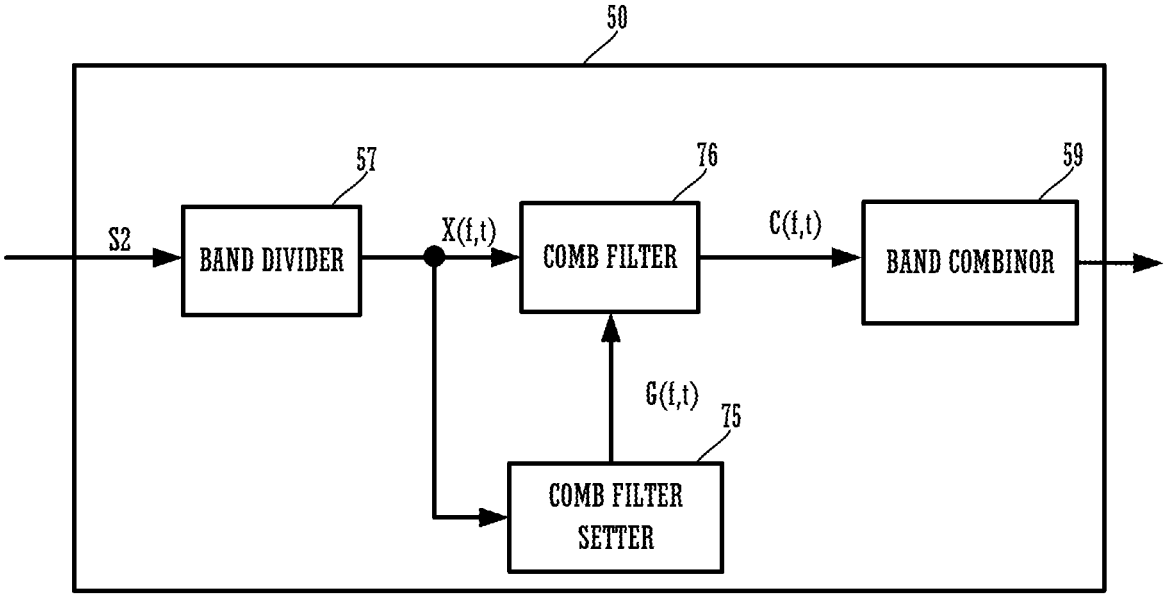
FIG. 9 is a block diagram showing a functional configuration of an emphasis processor 50.

Subsequently, FIG. 9 is a block diagram showing a functional configuration of an emphasis processor 50. A band divider 57 converts the signal into a signal X(f, t) of a frequency axis by applying the Fourier transform to the sound pickup signal S2. A band combiner 59 performs processing to convert an output signal C(f, t) of the comb filter 76 back into a signal of a time axis.

Human voice (sound) has a harmonic structure having a peak component for each predetermined frequency. Therefore, the comb filter setter 75, as shown in the following Expression 5, passes the peak component of human voice, obtains a gain characteristic G(f, t) of reducing components except the peak component, and sets the obtained gain characteristic as a gain characteristic of the comb filter 76.

Expression 5

$$z(c, t) = DFT_{f\to c}\{\log|Z(f, t)|\}$$

$$c_{peak}(t) = \text{argmax}_c\{z(c, t)\}$$

$$z_{peak}(c, t) = \begin{cases} z(c_{peak}(t), t) & (c = c_{peak}(t)) \\ 0 & \text{otherwise} \end{cases}$$

$$G(f, t) = \begin{cases} IDFT_{c\to f}\{\exp(z_{peak}(c, t))\} & (F_0 < f < F_1) \\ 1 & \text{otherwise} \end{cases}$$

$$C(f, t) = G(f, t)^{\eta} Z(f, t)$$

In other words, the comb filter setter 75 applies the Fourier transform to the sound pickup signal S2, and further applies the Fourier transform to a logarithmic amplitude to obtain a cepstrum value z(c, t). The comb filter setter 75 extracts a c value $c_{peak}(0=\text{argmax}_c\{z(c, t)\}$ that maximizes this cepstrum value z(c, t). The comb filter setter 75, in a case in which the c value is other than $c_{peak}(t)$ or approximate value of $c_{peak}(t)$, extracts the peak component of the cepstrum as a cepstrum value z(c, t)=0. The comb filter setter 75 converts this peak component $z_{peak}(c, t)$ back into a signal of the frequency axis, and sets the signal as the gain characteristic G(f, t) of the comb filter 76. As a result, the comb filter 76 serves as a filter that emphasizes a harmonic component of human voice.

It is to be noted that the gain controller 21 may adjust the intensity of the emphasis processing by the comb filter 76, based on a calculation result of the coherence calculator 20. For example, the gain controller 21, in a case in which the value of the ratio R(k) is equal to or greater than the predetermined value R1, turns on the emphasis processing by the comb filter 76, and, in a case in which the value of the ratio R(k) is less than the predetermined value R1, turns off the emphasis processing by the comb filter 76. In such a case, the emphasis processing by the comb filter 76 is also included in one aspect in which the level control of the sound pickup signal S2 (or the sound pickup signal S1) is performed according to the calculation result of the correlation. Therefore, the sound pickup device 1 may perform only emphasis processing on a target sound by the comb filter 76.

Figure 8:
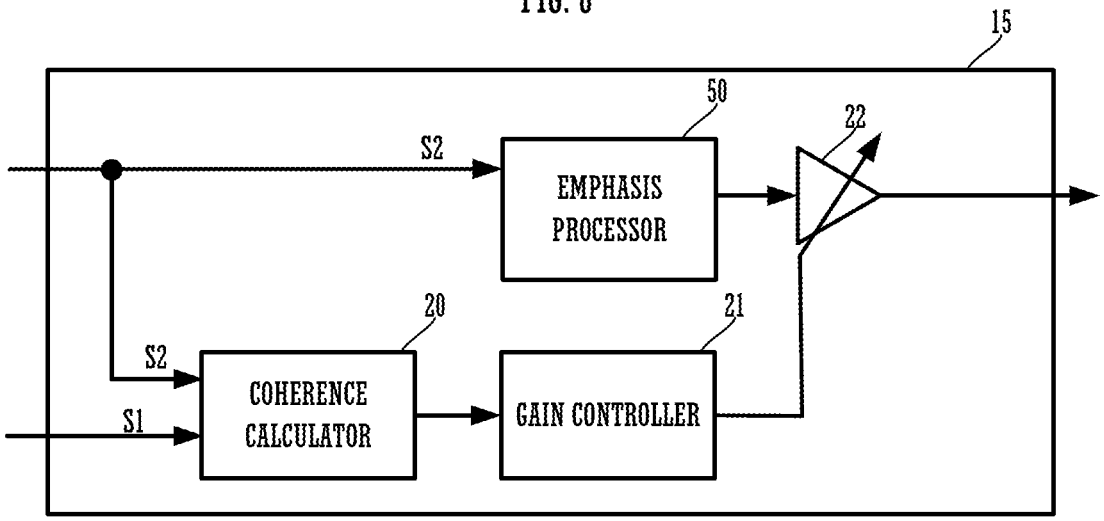
FIG. 8 is a view showing a configuration of a level controller 15 according to Modification 2.

It is to be noted that the level controller 15, as shown in FIG. 8, for example, may estimate a noise component, and may perform processing to emphasize a target sound by reducing a noise component by the spectral subtraction method using the estimated noise component. Furthermore, the level controller 15 may adjust the intensity of noise reduction processing based on the calculation result of the coherence calculator 20. For example, the level controller 15, in a case in which the value of the ratio R(k) is equal to or greater than the predetermined value R1, turns on the emphasis processing by the noise reduction processing, and, in a case in which the value of the ratio R(k) is less than the predetermined value R1, turns off the emphasis processing by the noise reduction processing. In such a case, the emphasis processing by the noise reduction processing is also included in one aspect in which the level control of the sound pickup signal S2 (or the sound pickup signal S1) is performed according to the calculation result of the correlation.

Figure 15:
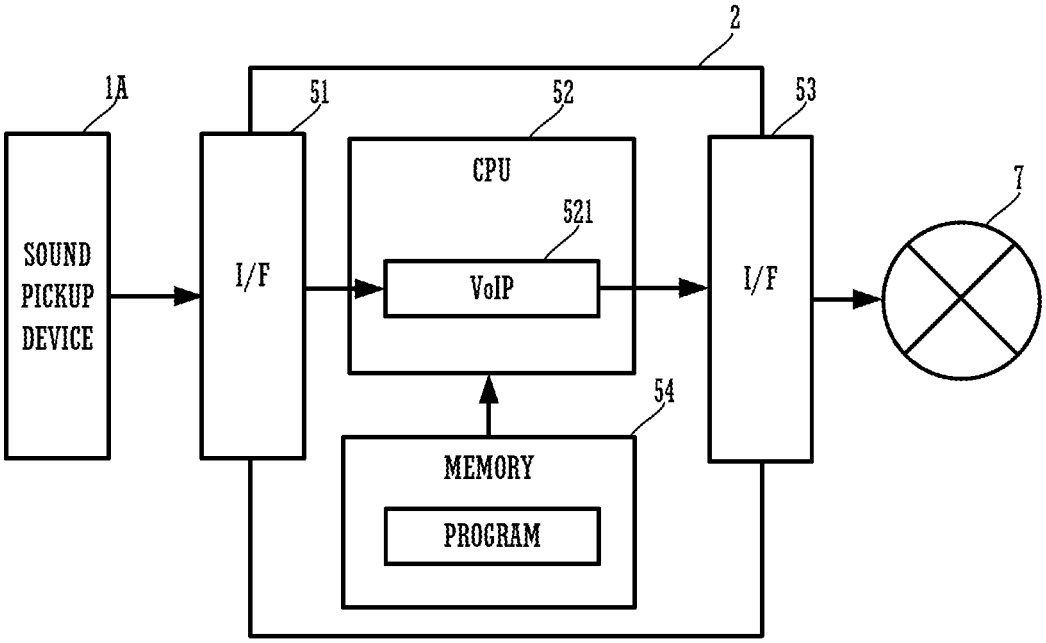
FIG. 15 is a block diagram showing an example of a configuration of an external device (a PC) to be connected to the sound pickup device.

FIG. 15 is a block diagram showing an example of a configuration of an external device (a PC: Personal Computer) 2 to be connected to the sound pickup device. The PC 2 includes an I/F 51, a CPU 52, an I/F 53, and a memory 54. The I/F 51 is a USB interface, for example, and is connected to the I/F 19 of the sound pickup device 1A, with a USB cable. The I/F 53 is a communication interface such as a LAN, and is connected to a network 7. The CPU 52 receives an input of a pickup signal from the sound pickup device 1A through the I/F 51. The CPU 52 reads out a program stored in the memory 54 and performs the function of a VoIP (Voice over Internet Protocol) 521 shown in FIG. 15. The VoIP 521 converts the pickup signal into packet data. The CPU 52 outputs the packet data that has been converted by the VoIP 521 to the network 7 through the I/F 53. As a result, the PC 2 is able to transmit and receive a pickup signal to and from another device to be connected through the network 7.

Therefore, the PC 2 is able to conduct an audio conference with a remote place, for example.

Figure 16:
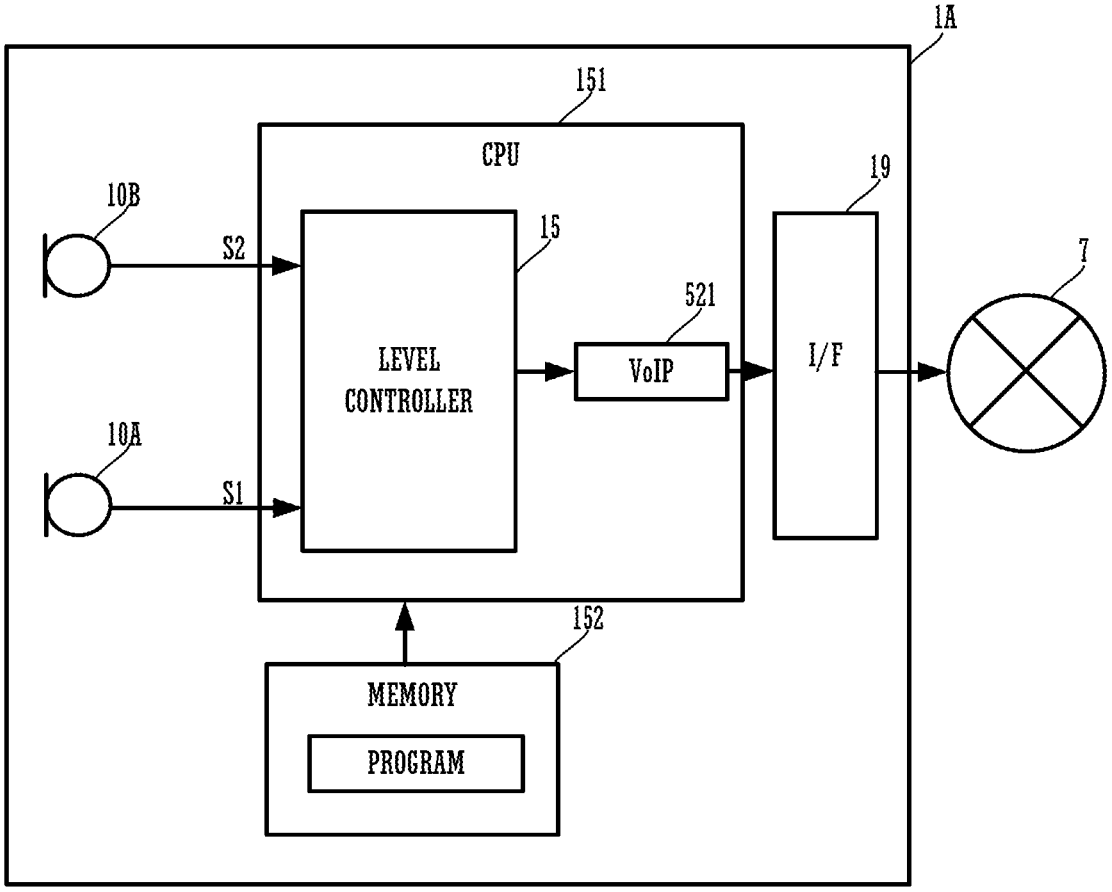
FIG. 16 is a block diagram showing an example of a configuration of the sound pickup device.

FIG. 16 is a block diagram showing a modification example of the sound pickup device 1A. In the sound pickup device 1A of this modification example, the CPU 151 reads out a program from the memory 152 and performs the function of a VoIP 521. In such a case, the I/F 19 is a communication interface such as a LAN, and is connected to the network 7. The CPU 151 outputs the packet data that has been converted by the VoIP 521 through I/F 19, to the network 7 through the I/F 19. Accordingly, the sound pickup device 1A is able to transmit and receive a pickup signal to and from another device to be connected through the network 7. Therefore, the sound pickup device 1A is able to conduct an audio conference with a remote place, for example.

Figure 17:
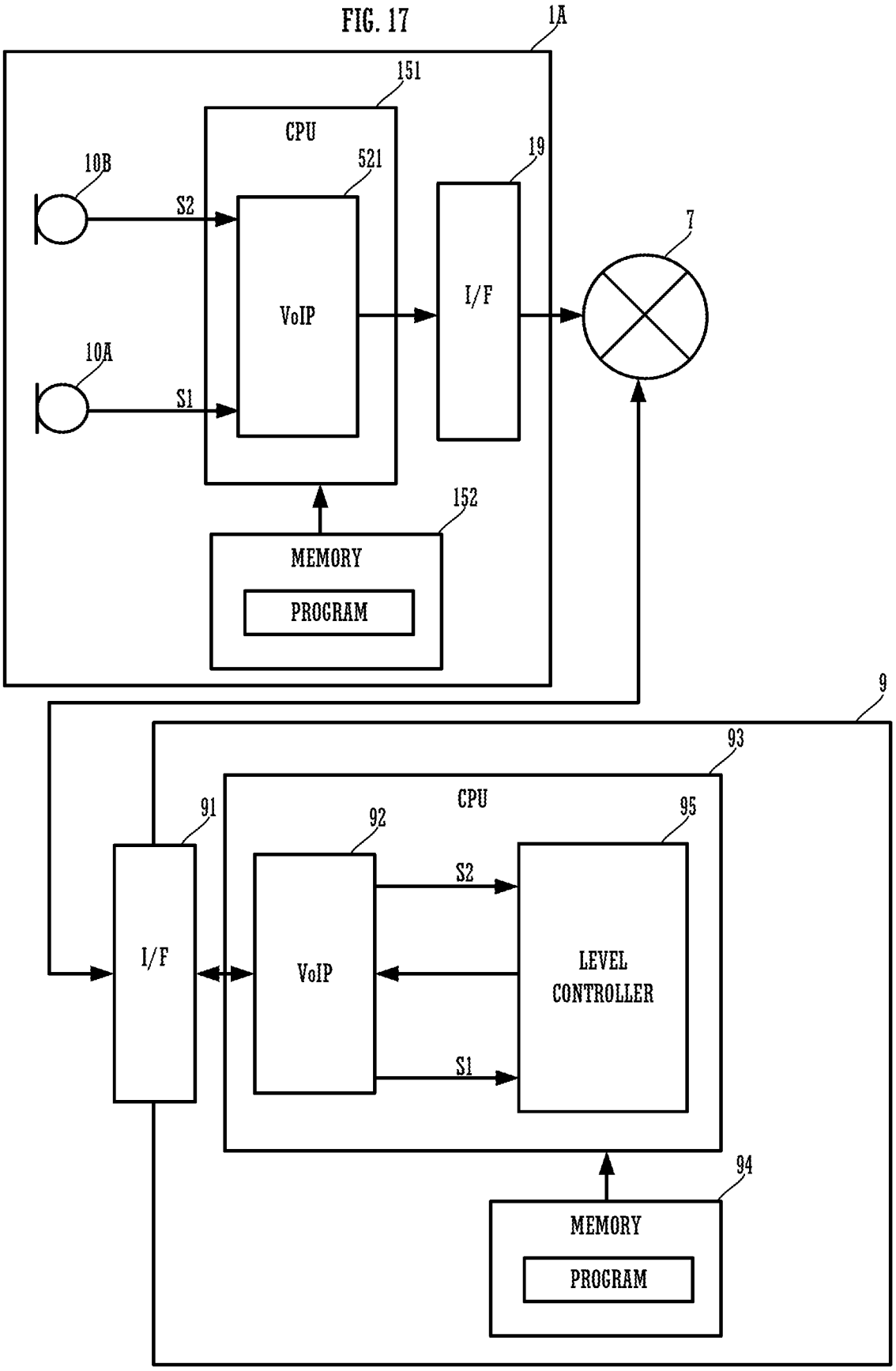
FIG. 17 is a block diagram showing an example of a configuration in a case in which the level controller is provided in an external device (a server).

FIG. 17 is a block diagram showing an example of a configuration in a case in which the configuration of the level controller 15 is provided in an external device (a server) 9. The server 9 includes an I/F 91, a CPU 93, and a memory 94.

In this example, the sound pickup device 1A does not include the level controller 15. The CPU 151 reads out a program from the memory 152 and performs the function of the VoIP 521. In this example, the VoIP 521 converts the pickup signal S1 and the pickup signal S2 into packet data, respectively. Alternatively, the VoIP 521 converts the pickup signal S1 and the pickup signal S2 into one piece of packet data. Even when being converted into one piece of packet data, the pickup signal S1 and the pickup signal S2 are distinguished, respectively, and are stored in the packet data as different data.

In this example, the I/F 19 is a communication interface such as a LAN, and is connected to the network 7. The CPU 151 outputs the packet data that has been converted by the VoIP 521 through I/F 19, to the network 7.

The I/F 91 of the server 9 is a communication interface such as a LAN, and is connected to the network 7. The CPU 93 receives an input of the packet data from the sound pickup device 1A through the I/F 91. The CPU 93 reads out a program stored in the memory 94 and performs the function of a VoIP 92. The VoIP 92 converts the packet data into the pickup signal S1 and the pickup signal S2. In addition, the CPU 93 reads out a program from the memory 94 and performs the function of the above-stated level controller 95. The level controller 95 has the same function as the level controller 15. The CPU 93 outputs again the pickup signal on which the level control has been performed by the level controller 95, to the VoIP 92. The CPU 93 converts the pickup signal into packet data in the VoIP 92. The CPU 93 outputs the packet data that has been converted by the VoIP 92 to the network 7 through the I/F 91. For example, the CPU 93 transmits the packet data to a communication destination of the sound pickup device 1A. Therefore, the sound pickup device 1A is able to transmit the pickup signal on which the level control has been performed by the level controller 95, to the communication destination.

It is to be noted that the I/F 91 is a USB interface, for example, and may be connected to the I/F 19 of the sound pickup device 1A, with a USB cable.

Finally, the foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. A sound pickup device comprising:

a calculator that:

obtains a first sound pickup signal to be generated from a first sound signal output by a first microphone and a second sound pickup signal to be generated from a second sound signal output by a second microphone;

converts the first sound pickup signal and the second sound pickup signal into a first frequency signal and a second frequency signal;

calculates a coherence between the first frequency signal and the second frequency signal; and calculates a ratio of a frequency component of which the calculated coherence exceeds a first threshold value with respect to all frequency components; and a level controller that controls a level of the first sound pickup signal or the second sound pickup signal according to the calculated ratio.

2. The sound pickup device according to claim 1, further comprising:

the first microphone; and the second microphone.

3. The sound pickup device according to claim 1, wherein the level controller determines whether or not the calculated coherence exceeds the first threshold value for each frequency component, obtains the calculated ratio by totaling the number of frequency components that exceeds the first threshold value with respect to the all frequency components.

4. The sound pickup device according to claim 1, wherein the level controller includes a directivity former that generates the first sound pickup signal and the second sound pickup signal from the first sound signal output by the first microphone and the second sound signal output by the second microphone.

5. The sound pickup device according to claim 4, wherein:

the first microphone and the second microphone are directional microphones, and the directivity former generates the first sound pickup signal having directivity, and the second sound pickup signal having non-directivity, from the first and second signals output by the first microphone and the second microphone.

6. The sound pickup device according to claim 4, wherein the directivity former generates the first sound pickup signal or the second sound pickup signal by obtaining a sum of delays of the first and second sound signals output by the first microphone and the second microphone.

7. The sound pickup device according to claim 1, wherein the level controller estimates a noise component, and reduces the estimated noise component from the first sound pickup signal or the second sound pickup signal to control the level thereof.

8. The sound pickup device according to claim 7, wherein the level controller, according to the calculated ratio, turns on or off the noise component reduction.

9. The sound pickup device according to claim 1, wherein the level controller includes a comb filter that reduces a harmonic component based on sound.

10. The sound pickup device according to claim 9, wherein the level controller, according to the calculated ratio, turns on or off processing by the comb filter.

11. The sound pickup device according to claim 1, wherein the level controller includes a gain controller that controls a gain of the first sound pickup signal or the second sound pickup signal.

12. The sound pickup device according to claim 11, wherein the level controller attenuates the gain according to the calculated ratio in a case where the calculated ratio is less than a second threshold value.

13. The sound pickup device according to claim 12, wherein the second threshold value is determined based on the calculated ratio calculated within a predetermined time.

14. The sound pickup device according to claim 11, wherein the level controller sets the gain as a minimum gain in a case where the calculated ratio is less than a second threshold value.

15. A sound pickup method comprising:

obtaining a correlation between a first sound pickup signal to be generated from a first sound signal output by a first microphone and a second sound pickup signal to be generated from a second sound signal output by a second microphone; and converting the first sound pickup signal and the second sound pickup signal into a first frequency signal and a second frequency signal;

calculating a coherence between the first frequency signal and the second frequency signal;

calculating a ratio of a frequency component of which the calculated coherence exceeds a first threshold value with respect to all frequency components; and controlling a level of the first sound pickup signal or the second sound pickup signal according to the calculated ratio.

16. The sound pickup method according to claim 15, further comprising determining whether or not the calculated coherence exceeds the first threshold value for each frequency component, obtaining the calculated ratio by totaling the number of frequency components that exceeds the first threshold value with respect to the all frequency components.

17. The sound pickup method according to claim 15, further comprising generating the first sound pickup signal and the second sound pickup signal from the first sound signal output by the first microphone and the second sound signal output by the second microphone.

18. The sound pickup method according to claim 17, wherein the generating generates the first sound pickup signal having directivity, and the second sound pickup signal having non-directivity, from the first and second signals output by the first microphone and the second microphone.

19. A sound pickup device comprising:

at least one memory device that stores instructions; and at least one processor that executes the instructions to:

obtains a first sound pickup signal to be generated from a first sound signal output by a first microphone and a second sound pickup signal to be generated from a second sound signal output by a second microphone;

converts the first sound pickup signal and the second sound pickup signal into a first frequency signal and a second frequency signal;

calculates a coherence between the first frequency signal and the second frequency signal;

calculates a ratio of a frequency component of which the calculated coherence exceeds a threshold value with respect to all frequency components; and controls a level of the first sound pickup signal or the second sound pickup signal according to the calculated ratio.

* * * * *